United States Patent [19]

Noel et al.

[11] Patent Number: 4,685,376

[45] Date of Patent: Aug. 11, 1987

[54] SEPARATION SYSTEM

[75] Inventors: Vincent R. Noel, Huntington Beach; Fred B. Van Shoubrouek, Westminster, both of Calif.

[73] Assignee: McDonnell Douglas Corporation, Long Beach, Calif.

[21] Appl. No.: 748,336

[22] Filed: Jun. 24, 1985

[51] Int. Cl.[4] ..... F42B 1/00; F42B 15/00

[52] U.S. Cl. ..... 89/1.14; 102/378; 60/632

[58] Field of Search ..... 89/1.14; 102/378; 60/632, 636

[56] References Cited

U.S. PATENT DOCUMENTS

| | | | |
|---|---|---|---|
| 3,087,369 | 4/1963 | Butterfield | 89/1.14 X |
| 3,185,090 | 5/1965 | Weber | 89/1.14 |
| 3,311,056 | 3/1967 | Noddin | 102/275.8 |
| 3,362,290 | 1/1968 | Carr et al. | 102/378 X |
| 3,373,686 | 3/1968 | Blain et al. | 89/1.14 |
| 3,486,410 | 12/1969 | Drexelius | 89/1.14 |
| 3,530,759 | 9/1970 | Francis | 89/1.14 X |
| 3,633,456 | 1/1972 | Carr et al. | 89/1.14 |
| 3,698,281 | 10/1972 | Brandt et al. | 89/1.14 |
| 4,106,875 | 8/1978 | Jewett | 102/378 |
| 4,493,241 | 1/1985 | Oliva et al. | 89/1.14 |

OTHER PUBLICATIONS

"Confined Explosive Separation System", R. E. Lake, McDonnell Douglas Corp., Jun. 1969.

*Primary Examiner*—David H. Brown

*Attorney, Agent, or Firm*—Paul T. Loef; George W. Finch; Donald L. Royer

[57] ABSTRACT

An explosively operated, confined linear explosive separation joint. The joint features a one-piece female member of a clevis type shape with shear lip grooves located on the outside surface of the clevis generally aligned with the fillet formed between the sidewall and the bottom of the opening in the clevis. The explosive means is contained in the bottom of the clevis portion with the male portion of the joint slideably nested in the clevis opening abutting the explosive. Shear lip groove alignment with the corner radius or fillet formed at the bottom of the clevis and the stiffer structure adjacent to the break point combine to ensure optimum use of the explosive energy and produce a joint which fails primarily in shear rather than tension, taking advantage of the materials weakest property.

7 Claims, 12 Drawing Figures

FIG. 1
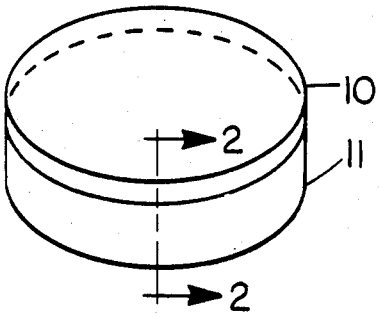
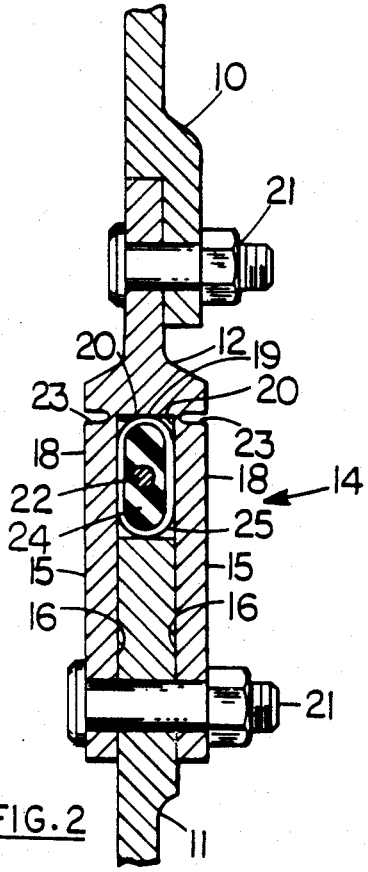
FIG. 2
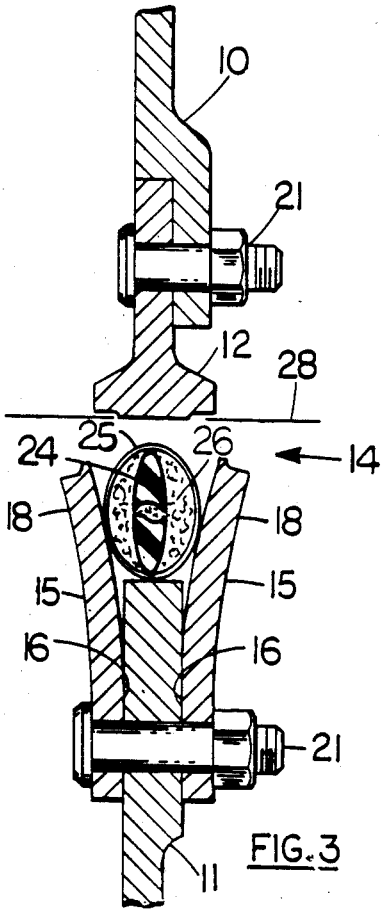
FIG. 3

(AT THE BOLTS)

(BETWEEN BOLTS)

(AT THE BOLTS)

(BETWEEN BOLTS)

(AT THE BOLTS)

(BETWEEN BOLTS)

SEPARATION SYSTEM

BACKGROUND OF THE INVENTION

This invention relates to confined explosive separation systems; and more particularly, to the separation joint portion of the explosively operated, linear charge, separation system most commonly observed separating space boosters from payload portions during space exploration.

Explosive separation systems are typically used for stage and payload separation, door and fairing jettison and shroud removal in various space applications. Basically, two different types of separation systems are used. Point separation systems utilize explosive bolts or nuts while linear separation systems utilize flexible linear shaped charge (FLSC) or mild detonating cord (MDC). Point separation systems employ rows of bolts, each of which is individually fired, or V-band clamp joints (Marman type clamp) using an explosive bolt to close the clamp. Of course, the sections to be joined must terminate in a shape to match the inner V section of the clamp. V-band clamp joints are structurally inefficient, resulting in understrength and overweight structure when used to support large diameter, heavyweight spacecraft.

Newer generation spacecraft are larger in diameter and heavier in weight and will not tolerate this structural inefficiency. Hence confined linear explosive separation systems were developed. Although several confined separation systems are in existence, they do not represent an optimum in the performance versus weight aspect.

One technique for accomplishing linear separation is taught in U.S. Pat. No. 3,373,686 to Blain, et al. Blain teaches enclosure of MDC in an elastomeric sheath (as taught in U.S. Pat. No. 3,311,056 to G. A. Noddin) which is confined between specially designed structure. The explosive products expand transmitting force through the medium of the elastomer to the structure and finally cause severance. This joint clearly fails in combined bending and tension as a result of the span between the rows of bolts, the mid location of the break slot, and the spacing between bolts. The primary failure is not in shear, because there is no rigidity to any portion of the joint.

Another technique is taught in U.S. Pat. No. 3,362,290 issued to W. F. Carr, et al. and assigned to the same assignee as this application. Carr teaches the piston and chamber combination with a linear explosive contained within two concentric stainless steel tubes which run the length of the joint. The stainless steel tubes are in turn confined within a thin walled elastomeric bellows which is in turn inflated by the hot gases of the explosive. The gases pass through a line of holes in each tube, oriented such that the holes in the two tubes are 180° apart to prevent perforation of the bellows by the fast moving hot particles from the exploding MDC. The piston and chamber are attached, one each, to the two parts of the contiguous sections to be separated by a line of retaining rivets. The hot gasses inflate the bellows, which in turn shears the retaining rivets and thrusts the two halves of the joint apart to provide the initial step in the separation operation. This is a thrusting joint and does not sever structure to achieve the separation, only a row of rivets. Further, this joint is very heavy and has very poor load carrying ability prior to separation.

Another approach to confined linear explosive separation systems is that taught by U.S. Pat. No. 3,486,410 issued to Drexelius, et al. and again assigned to the same assignee as this invention. This reference teaches a separation system based on tube expansion. Explosive cords are supported in an extruded plastic part which just fits inside of a flattened steel tube. When the explosive is fired, it produces gases which expand the flattened tube to produce the necessary displacement for a continuous structural severance and separation. The flattened tube is contained in a cantilevered clamping means by a single row of bolts which produces poor rigidity. Much of the work produced by the explosive is absorbed in bending and deflecting the clamp. There is some teaching of orienting the break slot to the location of the linear explosive. However, because of the structural arrangement, both the clamp and the parent structure being severed see mostly tension and bending and produces inefficient deflection prior to separation. Basically, any joint which is bolted in close proximity to the break line suffers from the fact that more energy (and displacement at the load point) is required between the bolts than at the bolts. Hence, the separation action is not continuous as it is with the one-piece design of the present invention.

Finally, U.S. Pat. No. 3,698,281 issued to O. E. Brandt, et al., also teaches an expanding tube separation joint quite similar to the '410 patent discussed above. However, this reference teaches a pair of explosive cords, spaced side by side in an elastomer and contained in a flattened steel tube. Further, the '281 patent teaches a pair of splice plates or doublers, one on either side and abutting the two sections to be joined with a space therebetween. The space contains the explosive cord in the flattened tube while the doublers are attached to the sections to be joined by a row of bolts at each end of the splice plates. Break slots are provided at the midpoint of each splice plate and located between the explosive cords. This reference suffers from the same deficiencies as the '410 patent in that the splice plates fail primarily in bending and tension as opposed to shear. The reason for this type of failure is the span subjected to the explosive force is too large, insufficient rigidity in the joint, and wrong location of the break slot. Bolt attachments are inefficient from a rigidity standpoint because of the spacing between bolts.

In summary, the expanding-tube type separation joints discussed above do not take optimum advantage of the explosive energy or inherent structural properties of the joint. These joints break at the end of the tube stroke when explosive forces are the least, and are designed to fail in tension, which is the materials strongest property.

It is an object of this invention to provide a separation joint which breaks at the separation plane in shear, which takes advantages of the materials weakest properties. It is a further object of the invention to provide a joint which breaks during the initial expansion of the tube enclosing the explosives, when explosive forces are at their greatest. Still further objects of the invention are to provide a light-weight, non-contaminating, structurally efficient separation joint which results in a continuous fracture as opposed to the discontinuous fracture of the bolted joints of the prior art.

SUMMARY OF THE INVENTION

In summary, the explosive separation joint of this invention accomplishes the above objects and overcomes the disadvantages of the prior devices by providing a one-piece female member having opposing flanges so as to be shaped like a clevis with a rigid cross section. Fillets are formed where the sidewalls of the clevis meet the bottom portion of the clevis. Opposite these fillets on the outside surfaces of the clevis are formed the shear lip grooves generally aligned with the fillets. The explosive means is contained in the bottom of the clevis portion. Slidably nested in the clevis abutting the explosive is the male member which is attached to another stage or payload by suitable means. While the joint is designed to accommodate an expanding metal tube containing the explosive so as to avoid contamination of the immediate vicinity at the time of separation, the tube is not essential to its function. The one piece forward section of the joint, as opposed to the splice plates of the prior art, results in an extremely efficient use of the output energy of the explosive because of the corner radius or fillet formed at the bottom of the clevis being aligned with the shear lip groove and combined with the stiffer structure adjacent to the break point. A stiffer structure ensures optimum use of the explosive energy in that the joint breaks at initial expansion of the tube, when explosive forces are the greatest, and fails in shear rather than tension, taking advantage of the materials weakest property.

BRIEF DESCRIPTION OF THE DRAWINGS

With reference to the drawings, wherein like reference numbers designate like portions of the invention:

FIG. 1 represents an assembly of two contiguous sections joined by the explosive separation joint at the reference line;

FIG. 2 is an enlarged section view through the separation joint cut at 2—2 in FIG. 1 prior to separation;

FIG. 3 is the same section as FIG. 2 except it shows the separation joint just after separation;

DESCRIPTION OF THE PREFERRED EMBODIMENT

Figure 4:
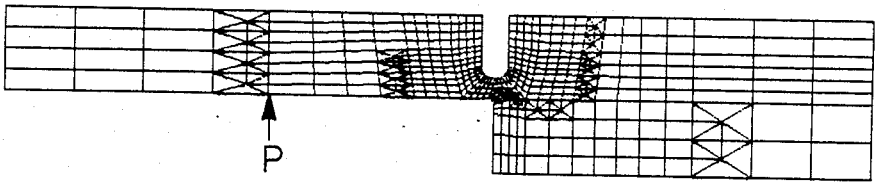
FIG. 4 is a plane-strain slice finite element model (FEM) generally representing a symmetrical one-half of the separation joint of this invention.

FIG. 1 is a perspective view of two contiguous sections, 10 the forward section and 11 the aft section, joined by an explosively operated linear separation joint which is shown as the reference line. The joint is shown in enlarged section at FIG. 2 prior to separation or initiation of the explosive. The female member 12 of the separation joint assembly 14, consists of a pair of opposing, spaced flanges 15 having inside surfaces 16 and outside surfaces 18. The inside surfaces 16 of the opposing flanges 15 intersect or terminate with the bottom portion 19 to form a fillet 20 at each intersecting corner. The female member 12 has a cross section view similar to a clevis. Located in the outside surfaces of the flanges 15 and generally aligned with the fillets 20 are an opposing pair of shear lip grooves 23. Mounting the female member 12 to the forward section 10 is accomplished by fastener assemblies 21, each consisting of a nut and bolt.

A linear explosive 22 is shown embedded in an elastomer 24 and contained in a flattened metal tube 25 which is located in the bottom of the female member 12. Actually, any explosive device of the linear type would be suitable, however, the expanding tube type shown provides a contamination free separation in that the products of detonation are contained.

The aft section 11 is shown nested between the inside surfaces 16 of the female member 12 and butting against the metal tube 25, all held in place by a plurality of fasteners 21.

FIG. 3 shows the same joint as FIG. 2 after firing the linear explosive 22 showing the gases of detonation 26 inside the elastomer 24 with the flattened tube 25 now shown in a rounded shape due to the pressure of the explosive gases 26, forcing the joint to shear at the shear plane 28, which is generally at the centerline of the shear lip groove 23.

FIG. 4 represents a plane-strain slice finite element model (FEM) which represents one-half of the symmetrical one-piece extruded design of the subject invention.

Figure 5:
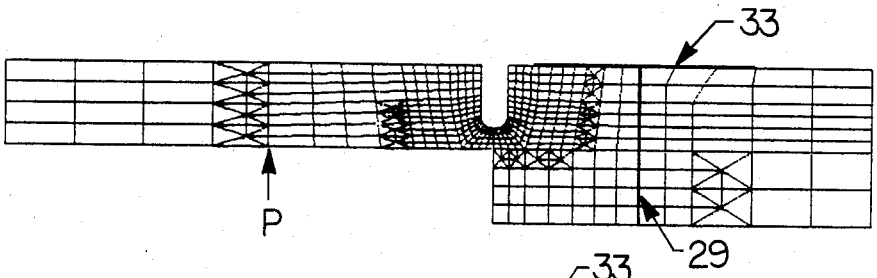
FIG. 5 PRIOR ART
FIG. 5 is an FEM generally representing the splice plate joint of the prior art at the bolts, with modifications as discussed herein.

FIG. 5 is an FEM generally representing the bolted joint of the prior art as depicted in U.S. Pat. No. 3,698,281 (discussed above) at the bolt.

Figure 6:
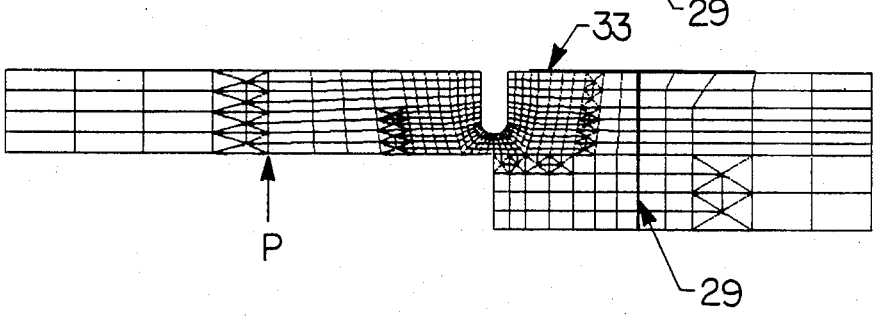
FIG. 6 PRIOR ART
FIG. 6 is an FEM generally representing the prior art between the bolts.

.FIG. 6 is also an FEM of the bolted design of the prior art except at the space between the bolts. FIGS. 5 and 6 represent the joint of FIG. 3A of the '281 patent except that the shear lip groove was located to a more optimum position which was confirmed by some initial modeling, since the objective was to minimize the load point displacement and minimize the work to cause joint separation. Inventions were changed to keep the models as similar as possible to obtain consistent results.

A computer structure analysis was made using the "NASTRAN" computer program which is a NASA proprietary computer program for stress analysis by finite modeling methods. This analysis was made to support experimentally determined advantages of the joint of the subject invention with that of the prior art.

The load due to the expanding tube was approximated by a point load, indicated as P on FIGS. 4–6, at the tube center. Bars 29 and 33 were used to model the bolt and bolt head respectively. The only difference between the two bolted models, i.e., at the bolt and between the bolts, was a bolt preload which was included at the bolt (by enforced deformation of the bar) but not between the bolts and bar stiffnesses were decreased between bolts in order to estimate the effect of bending and torsion as the strap deflection between bolts exceeded that at the bolt.

Figure 7:
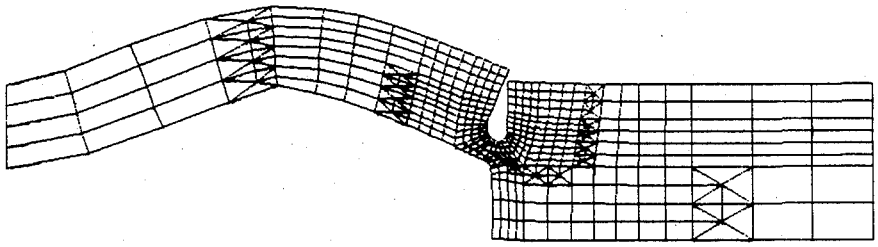
FIGS. 7, 8, and 9 are exaggerated deformed shapes of the FEMs represented by FIGS. 4, 5 and 6.
Figure 8:
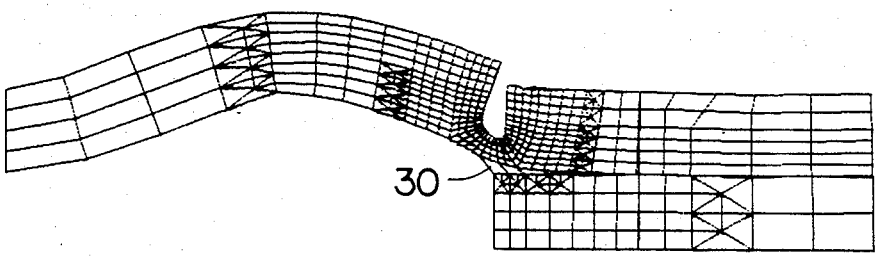
FIG. 8 PRIOR ART
Figure 9:
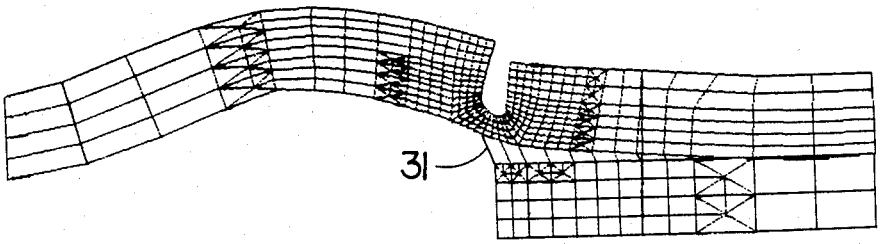
FIG. 9 PRIOR ART

Exaggerated deformed shape plots were made of the two configurations and are shown in FIGS. 7–9 with FIG. 7 representing the subject invention and FIGS. 8 and 9 representing the prior art at the bolt and between the bolts respectively. Gapping of the bolted joint of the prior art was apparent as indicated by 30 and 31 in FIGS. 8 and 9. While the loads and deflections must be normalized to the desired stress levels, the exaggerated deformed shapes are a good indication of the general deflection of the structure.

Figure 10:
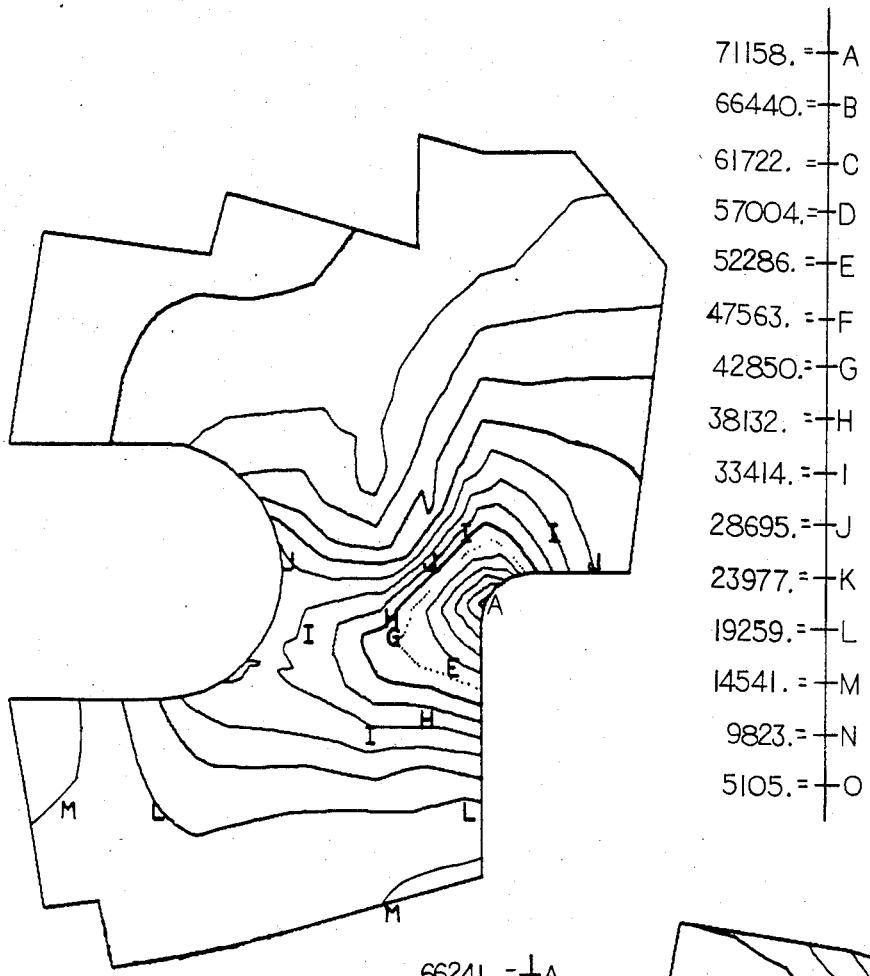
FIGS. 10, 11 and 12 are enlarged octahedral shear stress contours at the shear lip groove location for FIGS. 4, 5 and 6 respectively.
Figure 11:
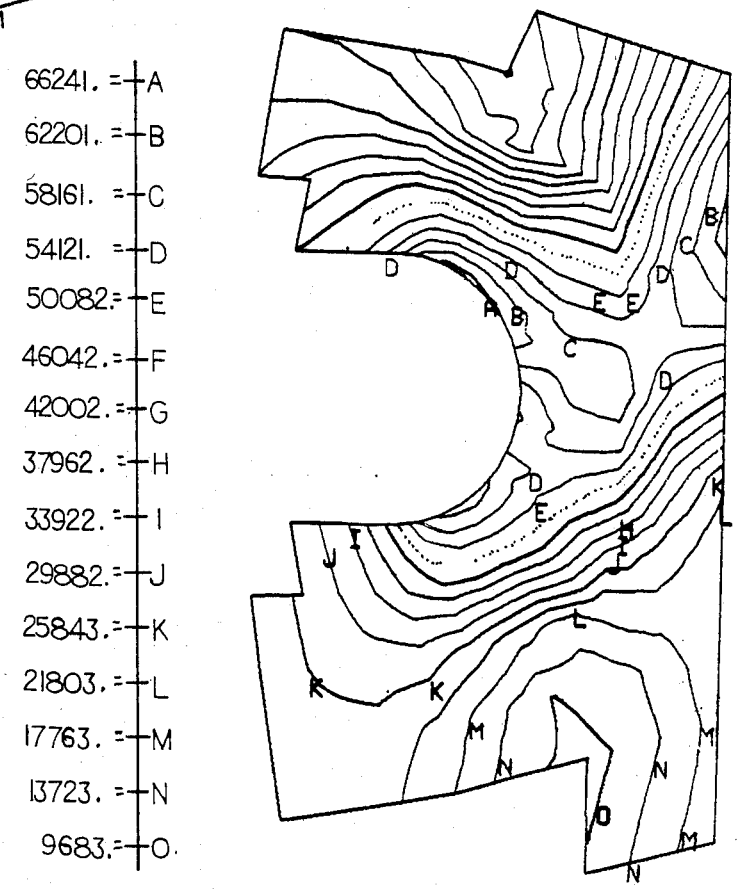
FIG. 11 PRIOR ART
Figure 12:
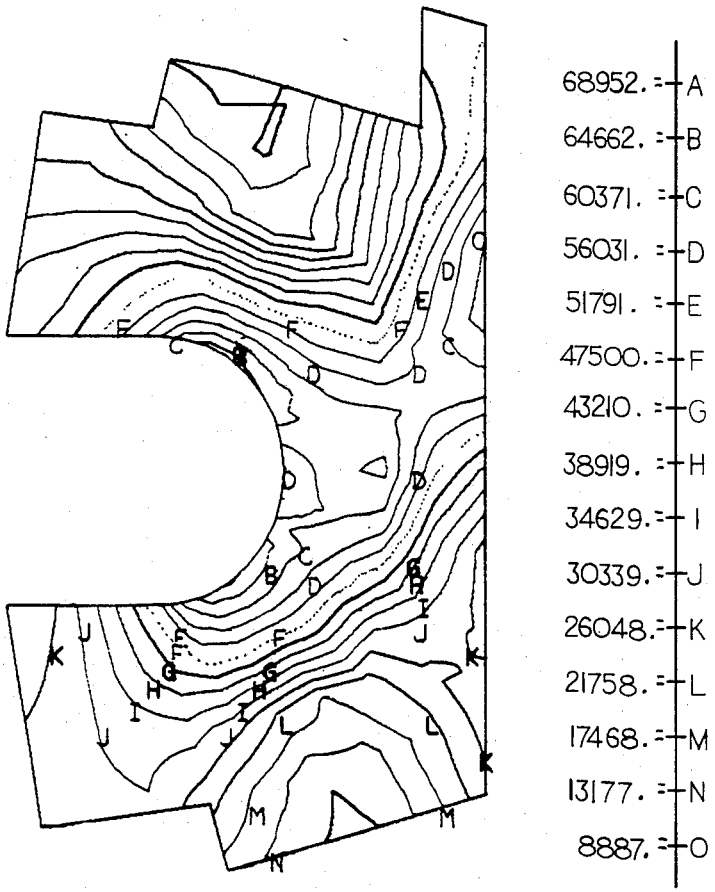
FIG. 12 PRIOR ART

Octahedral shear stress contours were also made as reflected in FIGS. 10–12 with 10 representing the instant invention and 11 and 12 representing the prior art at the bolt and between the bolts respectively. Maximum stress in the bolted design of the prior art occurred at the notch as indicated by the A in FIG. 11 and B in FIG. 12. In the one-piece joint model of the instant invention, as shown in FIG. 10, maximum stress occurred at the fillet as indicated at the A and failure did occur by predominantly shear stresses from the fillet directly to the groove. The bolted design of the prior art results in a longer failure path from initiation, at the side of the notch to the inside surface, on a curved path.

Plasticity effects cause an even larger difference between the one-piece and bolted joints. Since the highest stress in the latter occurs opposite the load, as previously mentioned, yield due to beam bending causes more tension and less shear at the groove. Since the shear allowable is nearly half the tensile allowable, the adverse affects of this are obvious.

Consideration of the decreasing load due to tube expansion will also result in a larger difference between the two joint designs. Load point deflection is much greater in the bolted design to cause a given stress at the groove.

The linear-elastic finite element analyses of both of the separation joints indicates the one-piece design of the subject invention results in separation with only 51% of the load point displacement and 33% of the work required for separation of the bolted design (between bolts) of the prior art. Further, separation of the bolted design requires 17% more displacement, and 29% more work, between bolts than at the bolt. This structural analysis clearly shows the one-piece separation joint of the instant invention to be significantly superior, in terms of ease of separation, to the bolted joint design of the prior art. This is true because the difference in work and displacement required between the bolts and at the bolts results in a discontinuous fracture in the bolted joint.

It can thus be seen that the preferred embodiment of this invention, separates when the explosive forces are greatest, fails in shear and takes advantage of the materials weakest properties and serves to solve the indicated problems as well as accomplish the objectives noted. This invention is not limited to the embodiment disclosed above. All changes and modifications thereof not constituting deviations from the spirit and scope of this invention are intended to be included.

What is claimed is:

1. An explosively operated linear separation joint for structurally joining and separating first and second contiguous sections, comprising:

a female member having opposing flanges with an opening portion therebetween so as to form a clevis shape having two opposite outside flange surfaces and two opposing inside flange surfaces and a bottom surface, the intersection of said inside flange surfaces and said bottom surface forming a moderately sharp fillet at the line of intersection;

shear lip grooves located in said outside flange surfaces so as to form a line of fracture;

explosive means contained in said opening portion of said female member;

a male member sized to slidably nest within said opening in said female member and against said explosive means; and means to attach said male member to said female member spaced from said line of fracture.

2. The explosively operated linear separation joint of claim 1 wherein said shear lip grooves located in said outside flange surfaces are generally opposite and in line with said fillets.

3. The explosively operated linear separation joint of claim 1 wherein said female member is a one-piece extrusion.

4. The explosively operated linear separation joint of claim 1 Wherein said female member is a one-piece forging.

5. The explosively operated linear separation joint of claim 1 wherein said explosive means is at least one linear explosive contained in an elastomer.

6. The explosively operated linear separation joint of claim 1 wherein said explosive means is at least one linear explosive contained in an elastomer and surrounded with a metal tube.

7. An explosively operated linear separation joint for structurally joining and separating first and second contiguous sections, comprising:

a female member having opposing flanges with an opening portion therebetween so as to form a clevis shape having two opposite outside flange surfaces and two opposing inside flange surfaces and a bottom surface, the intersection of said inside flange surfaces and said bottom surface forming a fillet at the line of intersection;

shear lip grooves located in said outside flange surfaces generally opposite and in-line with said fillets;

explosive means contained in said opening portion of said female member;

a male member sized to slidably nest within said opening in said female member and against said explosive means; and means to attach said male member to said female member.

* * * * *